US005984151A

United States Patent [19]

Lohrman et al.

[11] Patent Number: 5,984,151

[45] **Date of Patent: *Nov. 16, 1999**

[54] DISPENSING PUMP HAVING UNIVERSAL PUMP BODY AND READILY ATTACHABLE SHROUD SELECTED FROM READILY ATTACHABLE SHROUDS OF DIFFERENT OUTWARD SHAPES

[75] Inventors: Richard D. Lohrman, Sylvania; Wing-Kwong Keung, Perrysburg, both of Ohio

[73] Assignee: Owens-Illinois Closure Inc., Toledo, Ohio

[ * ] Notice: This patent is subject to a terminal disclaimer.

[21] Appl. No.: 09/249,412

[22] Filed: Feb. 12, 1999

[51] Int. Cl.[6] ..... B67D 5/40; A12C 11/00

[52] U.S. Cl. ..... 222/383.1; 222/182; 222/384; 239/333

[58] Field of Search ..... 222/383.1, 384, 222/182; 239/333

[56] References Cited

U.S. PATENT DOCUMENTS 5,172,836 12/1992 Warner ..... 222/383.1
5,366,121 11/1994 Foster et al. ..... 222/383.1
5,706,984 1/1998 Tada et al. ..... 222/182
5,749,501 5/1998 Maas et al. ..... 222/384
5,890,632 4/1999 Chalupsky et al. ..... 222/383.1

FOREIGN PATENT DOCUMENTS

96/14938 5/1996 WIPO .

*Primary Examiner*—Kevin P. Shaver
*Assistant Examiner*—Keats Quinalty

[57] ABSTRACT

Outward flanges on top of pump outlet tube include a rearward latching section. The shroud is open-fronted. Extending downward along the top wall of the shroud are a pair of opposed channels to the rear of which are unitary downward locking wedges. In assembly, the open-fronted shroud is moved forward from the rear onto the pump body in a simple uni-directional linear movement, the channels receiving the outward flanges respectively. The wedges forcefully engage and pass the latching sections and take positions in front of them to block retreat of the shroud.

9 Claims, 5 Drawing Sheets

DISPENSING PUMP HAVING UNIVERSAL PUMP BODY AND READILY ATTACHABLE SHROUD SELECTED FROM READILY ATTACHABLE SHROUDS OF DIFFERENT OUTWARD SHAPES

FIELD OF THE INVENTION

This invention relates to a trigger-type pump dispenser comprising a pump body and a shroud covering the pump body. More specifically, the invention relates to means by which a shroud selected from a variety of shapes and colors may be readily attached to the pump body in a uni-directional linear movement as by automatic assembly equipment. The invention relates to the meritorious invention described in patent application Ser. No. 08/881,945 filed Jun. 25, 1997, now U.S. Pat. No. 5,890,632. It is especially suitable for, but, of course, not limited to, use with trigger-type dispensing pumps of the type described in the McKinney U.S. Pat. No. 4,161,288 issued Jul. 17, 1979.

BACKGROUND OF THE INVENTION

The prior art includes a number of trigger-type dispensers in which a selected shroud can be attached to the pump body. The prior art includes, for instance, the Hellenkamp U.S. Pat. No. 3,820,721 issued Jun. 28, 1974, wherein, for the purpose of identification, a shroud bearing an identification number can be snapped onto the body of a pump.

More with a view to satisfying consumer desires as to the appearance of the dispenser, there is the Cary et al U.S. Pat. No. 4,257,539 issued Mar. 24, 1981. In this patent, during assembly the front end of the shroud is hooked over the front end of the pump body with the rear of the shroud high in the air. In the final assembly motion, the rear of the shroud is pressed downward to snap over an edge of the pump body in an over-center installation.

Foster et al U.S. Pat. No. 5,366,121 issued Nov. 22, 1994, has a shroud formed with forward hooks which fit into appropriate openings in the pump body when the shroud is placed on the pump body.

The attachment of the shrouds of the prior art to pump bodies has not been as readily accomplishable by automatic assembly equipment as has been desired. Further, the attachment has lacked sufficient security to hold the body and shroud together as a unit in a reliable manner.

SUMMARY OF THE INVENTION

It is a object of the present invention to provide a shroud selectable from an infinite array of possible shroud shapes and colors and a universal pump body whereby the assembly of the selected shroud onto the body can be readily accomplished by automatic assembly equipment to result in an assembly of improved security.

The invention is a trigger-sprayer-type dispensing pump comprising a pump body having a pump chamber supported on a tubular support, the chamber having a generally horizontal outlet tube. A pair of spaced parallel webs extend upward from the outlet tube and have outward flanges at the tops thereof. Lengthwise the flanges are in two longitudinal sections interrupted by a space and comprise a rear latching section and a forward support section. A horizontal shelf extends outward from the tubular support at the rear spaced down from the flanges.

The shroud is an open-front unitary molded element having a top wall, connected wide walls and a rear end wall. Extending down along the top wall are a pair of opposed channels, to the rear of which are unitary locking wedges. A horizontal shoulder is unitarily formed inward from the rear end and side walls spaced down from the channels.

In assembly, the open-fronted shroud is moved from the rear onto the pump body in a uni-directional linear movement, the channels receiving the outward flanges respectively. As the latching sections encounter the locking wedges, the latching sections flex downward and then, after the locking wedges have passed, snap back, locking the shroud on the pump body. Equivalent results within the scope of the present invention can be achieved when the wedges rise over the latching sections and then snap back down or when both the wedges and latching sections each flex to facilitate the snap-fit. At the same time, the horizontal shoulder engages the shelf on the tubular support and slides underneath it to hold the rear of the shroud down securely in place.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 4:
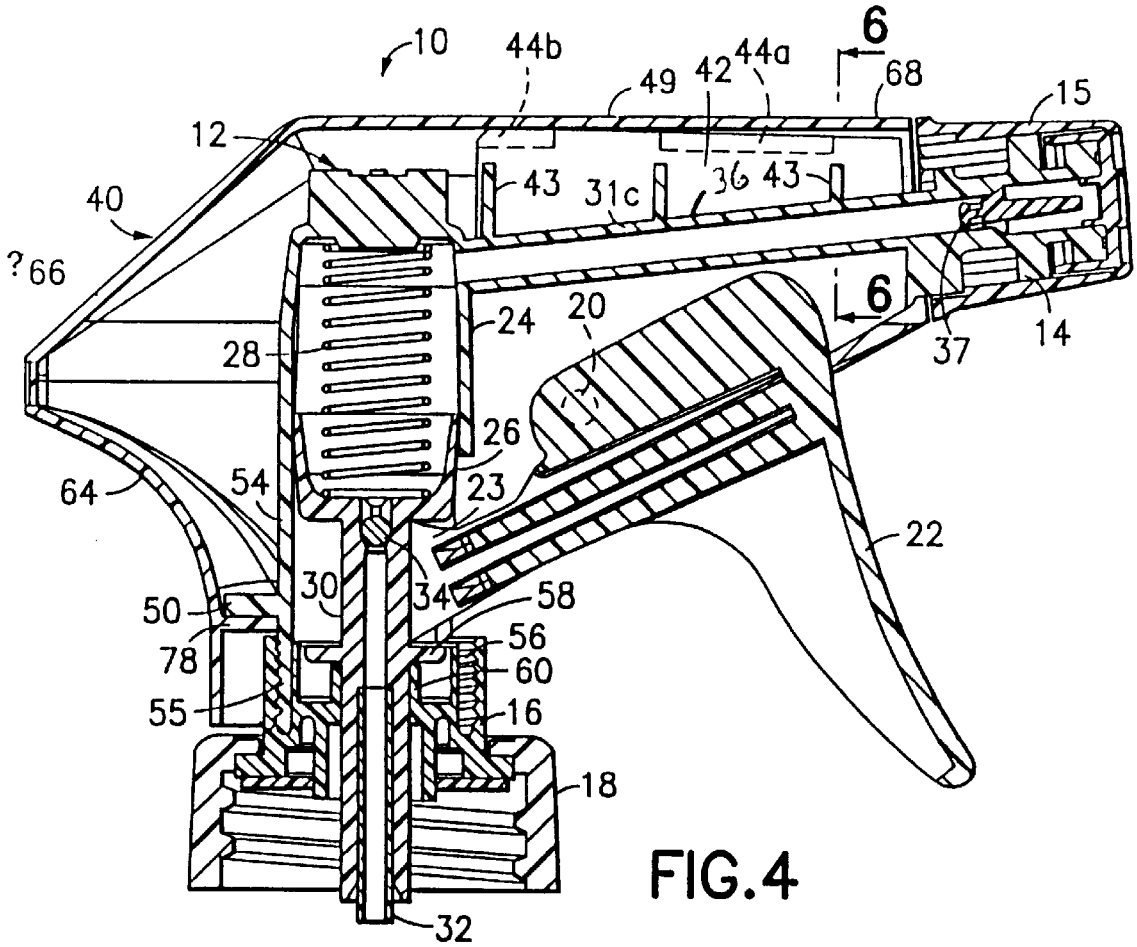
FIG. 4 is a sectional view taken on the centerline of a fully assembled trigger pump dispenser embodying the invention.

A dispensing pump embodying the invention is shown in section in FIG. 4 and generally designated 10. It comprises a pump body 12 formed with a nozzle 14 having a nozzle cap 15 secured on the front end thereof, a supporting collar 16 and a cap 18 by which the dispenser can be sealingly secured onto a container (not shown).

Pivotally secured in the pump body on trunions 20 is an operating trigger 22 having a working arm 23. The body 12 includes a cylinder 24 in which operates a piston 26 which may be biased downwardly by spring 28. The piston has a tubular stem 30 which extends downward therefrom and is connected to a dip tube 32. The stem is provided with an inlet ball check 34.

Extending outwardly from the upper end of the cylinder is a substantially horizontal outlet tube 36 which is provided with an outlet check 37 axially moveable in an enlarged space in the end of the outlet tube 36. The outlet tube may be angled slightly from the horizontal (for instance 7°) to promote draining toward the pump chamber in cylinder 24. The outlet check 37 is as described in the patent application Ser. No. 08/552,768 filed Nov. 3, 1995 by Richard J. Smolen, Jr., now U.S. Pat. No. 5,687,877, and assigned to the assignee of the present application. The disclosure of the Smolen, Jr. patent application is incorporated by reference hereinto. A shroud 40 is provided and fits over the body 12 to conceal it from view from most directions.

In operation, illustratively as in McKinney, when the trigger is squeezed toward the container, the piston is driven up by working arm 23, pushing liquid in the cylinder out through the outlet tube 36 past the outlet check 37 and through the nozzle 14. Other outlet check valves and nozzle configurations, such as shown in the McKinney patent, the disclosure of which is herein by reference, may be used.

When the trigger 22 is released, the piston is driven downward by spring 28, creating a vacuum which sucks liquid from the dip tube 32 up past the inlet ball check 34 into the chamber within the cylinder 24. The outlet check 37 performs as described in the Smolen application.

Figure 1:
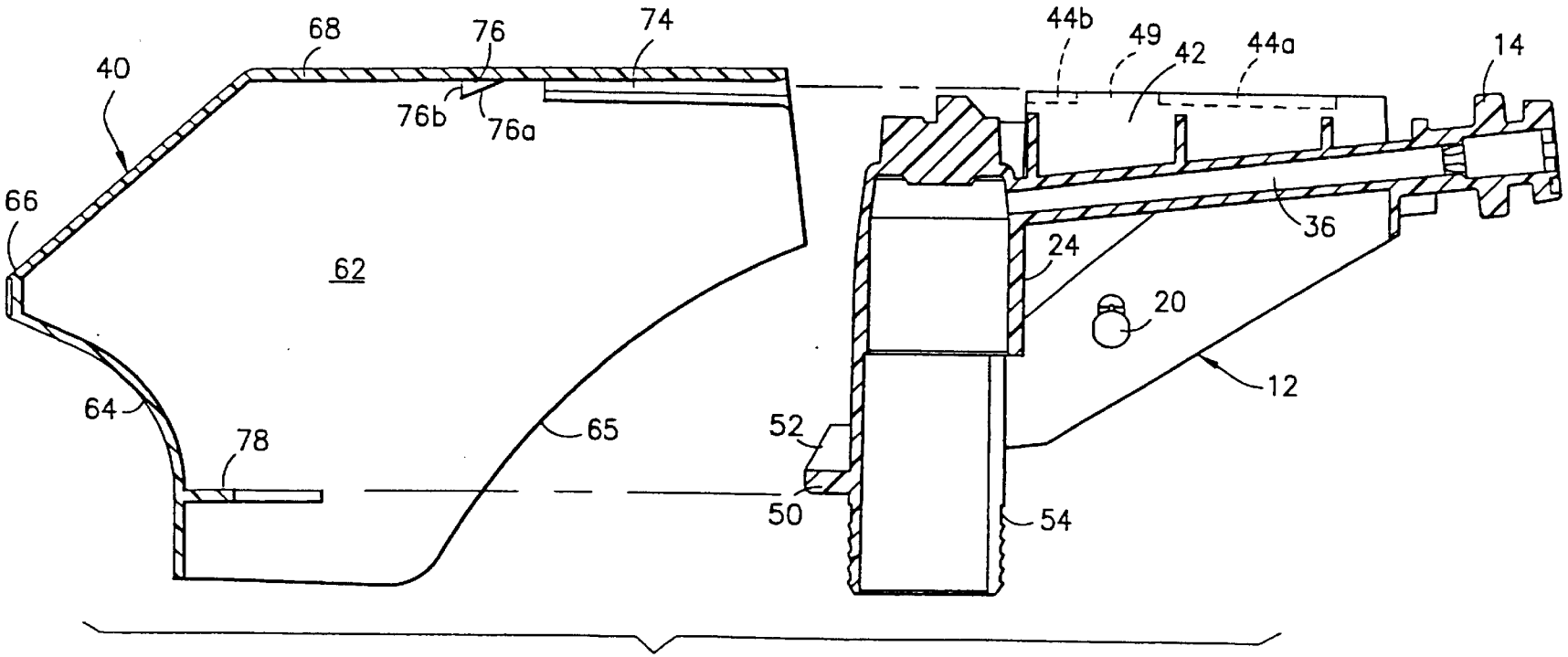
FIG. 1 is an exploded sectional view showing a pump body and shroud embodying the invention.

The present invention relates to the innovative shroud 40 and pump body 12 (FIG. 1). These parts are structured under the invention so that a selected shroud 40 can be mounted easily in permanent installation on the pump body 12. A benefit of the invention is that many different shaped and colored shrouds 40 can be designed for or made available for selection by a customer and the selected one can be installed on the pump body in a simple one-directional assembly motion.

Thus, it is possible to offer in the practice of the invention a variety of shrouds having the same internal characteristics but having different external or surface contours or appearances, the latter being determined by merchandising or consumer preferences.

Figure 3:
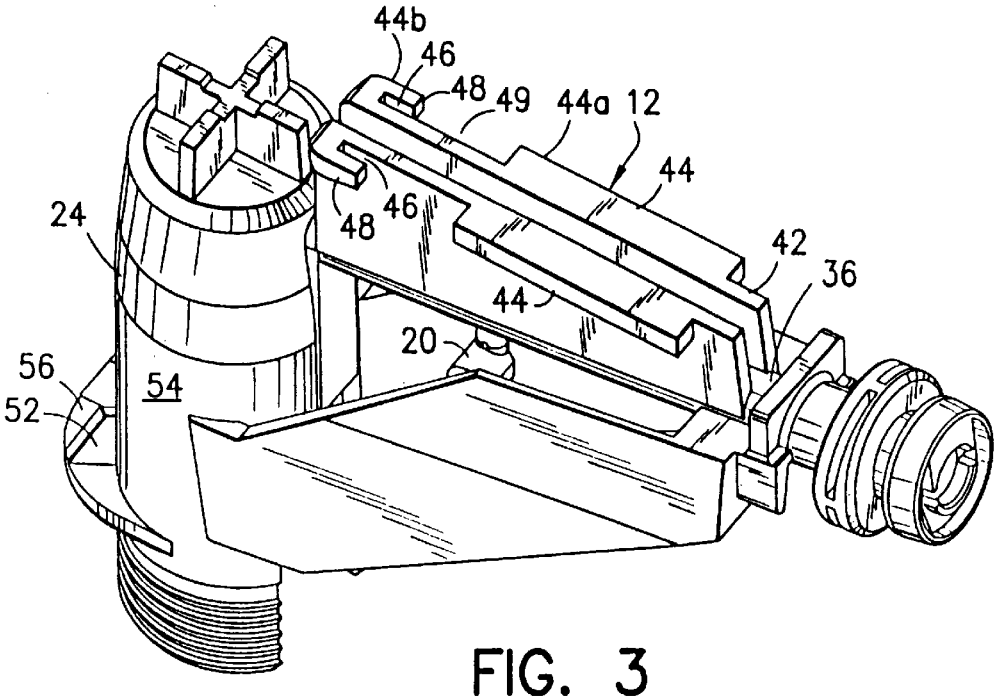
FIG. 3 is a perspective view from above of the pump body.

Attention is now directed to the pump body 12 as shown in FIGS. 3 and 4. The outlet tube 36 previously referred to has molded unitarily therewith a pair of spaced parallel vertical webs 42. The webs 42 are reinforced by transverse vanes 43. Along the upper end of the webs 42 extend outward flanges 44 which are each in two sections, a supporting section 44*a* and a latching section 44*b*. The latching section 44*b*, as shown best in FIG. 3, has a rearwardly running slot 46 which leaves the forward part of the latching section as a cantilevered finger 48. The slot 46 reduces the connection of the latching section 44*b* with the web to make the latching section 44*b* more able to flex for a purpose which will appear. Alternatively, the latching section 44*b* may be connected all along its short length to the web 42. The supporting section 44*a* and the latching section 44*b* are separated by an interruption 49 (FIGS. 1, 3 and 5).

Spaced downward below the cylinder and extending unitarily out from the body is a horizontal shelf 50 which may have unitary buttressing webs 52 spaced therealong to support the shelf from above against upward displacement. The pump body further comprises a tubular support 54 extending up to the cylinder 24 and supporting same. The lower end of the tubular support has serrations 55 on the outside and is pressed into a serrated annular channel 56 in the collar 16 in fixed installation. An outward annular stop flange 58 is formed unitarily with the piston stem 30 and serves as a stop for the lower end of travel of the piston as it hits an upward sleeve 60 of the collar 16. The stop flange 58 and the lower wall of the piston 26 entrap and provide working surfaces for the working arm 23 of the trigger 22.

Figure 2:
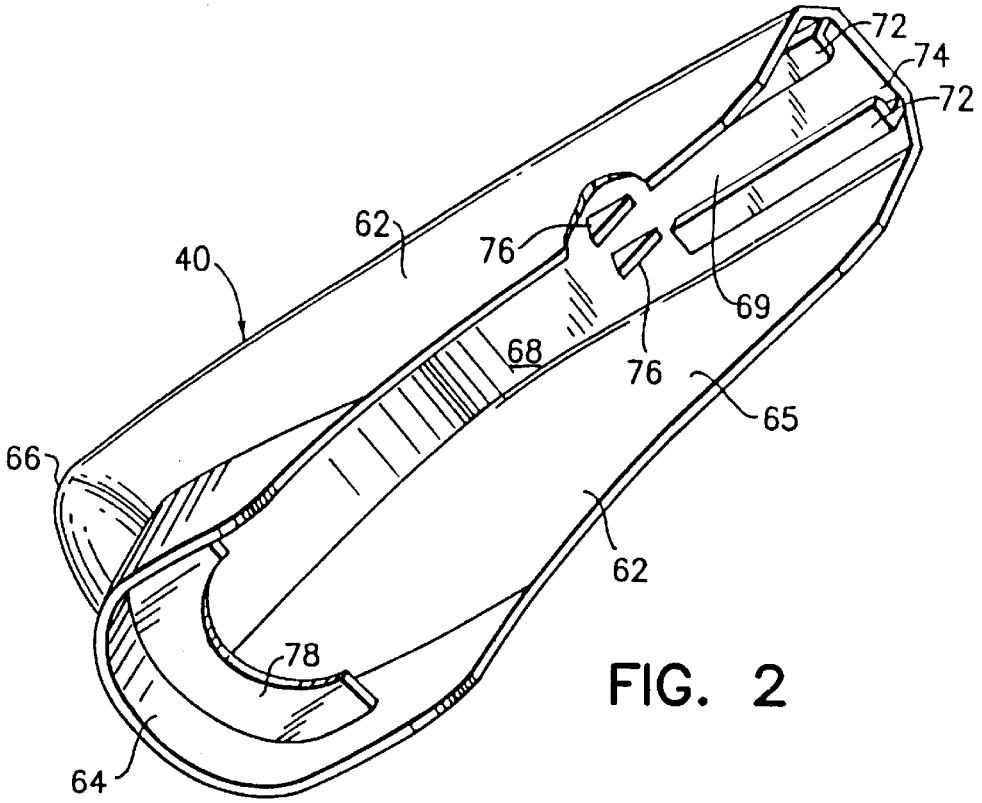
FIG. 2 is a perspective view from the underside of the shroud with a part of a side wall broken away.

The shroud 40 is shown in FIG. 2 and comprises side walls 62 and a curving rear end wall 64. It has an open front 65 (FIGS. 1, 2). As shown, the rear end wall 64 may extend gracefully rearward in its mid-section to a peak 66 which serves as a convenient rest for the web between thumb and index finger in manually operating the dispenser. The shroud is also formed unitarily with top wall 68. The top wall 68 may have downwardly angled portions 70 (FIG. 6) which meet the side walls 62 seamlessly.

Figure 5:
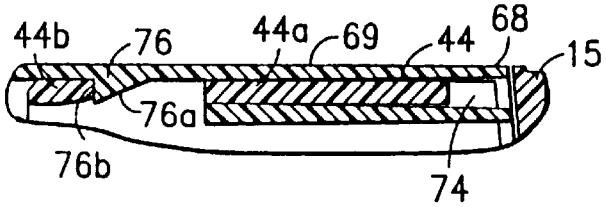
FIG. 5 is a fragmentary sectional view taken on the line 5—5 of FIG. 6.
Figure 6:
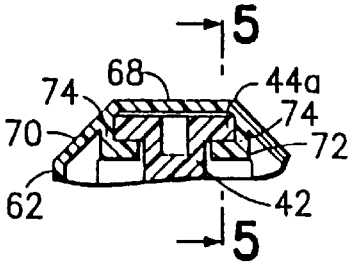
FIG. 6 is a fragmentary sectional view taken on the line 6—6 of FIG. 4.

As best shown in FIGS. 5, 6, the front portion 69 of the top wall 68, 70 is formed with downward L-shaped extensions 72 to define opposed channels 74 capable of receiving the flanges 44 of the pump body as will be explained.

Formed unitarily on the underside of the top wall 68 are locking wedges 76 (FIG. 5). They are positioned rearward from the channels 74 respectively and generally aligned therewith (FIG. 2). Each of the locking wedges 76 has a sloping portion 76*a* (FIG. 1) facing the aligned channel 74 and an abrupt vertical rear end 76*b*.

Unitarily formed in the molding of the shroud is the inward curving shoulder 78 (FIG. 2) which is inward from the rear end wall 64 and portions of the side walls 62.

The assembly of the shroud onto the pump body is a simple uni-directional linear movement. As shown in FIG. 1 with the aid of projection lines, the shroud 40 is initially positioned to the rear of the pump body 12 with its open front 65 facing the pump body. The shroud 40 is moved forward over the pump body 12 with the leading end of the channels 74 aligned respectively with the flanges 44 on the top of the pump body.

Figure 7A:
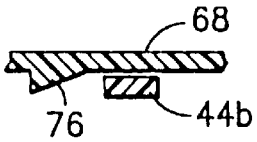
FIGS. 7*a,* 7*b* and 7*c* are fragmentary progressive views of one of the locking ramps of the shroud passing by one of the flexing latching sections on the pump body.
Figure 7B:
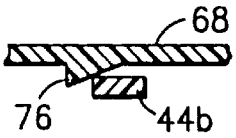
Figure 7C:
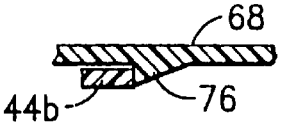

As this movement progresses, the latching sections 44*b* on the pump body enter the respective channels 74 (FIG. 7*a*) followed by the support sections 44*a*. When each latching section 44*b* encounters the locking wedge 76, the latching section 44*b* gradually flexes (FIG. 7*b*) downwardly, or the wedge 76 may rise to pass over the latching section. When the locking wedge has passed the latching section 44*b*, the wedge snap-fits with the latching section 44*b* so that the latching section thereafter blocks retreat by engagement with 76*b* of the locking wedge 76 (FIG. 7*c*). The channels 74 hold the front of the shroud firmly against upward displacement with respect to the top of the pump body 12.

FIG. 5 shows in fragmentary section the completed installation of the shroud 40 onto the pump body 12 with one of the supporting section 44*a* installed in the channel 74 and latching section 44*b* in snap-fit engagement with the locking wedge 76.

As an alternative, depending on the relative resilience of the parts or the relative freedom of movement of the parts, the actual latching movement may be the upward movement of the wedges 76 and a portion of the shroud as the wedges ride up over the latching sections 44*b*, and then snap down, restoring the shroud to its original height or condition and blocking retreat of the shroud. The action may be a combination of these alternative movements. All of these movements are deemed equivalent and a reference to one of them is intended to cover the others.

Some time prior to the snapping engagement of the locking wedges 76 with the latching sections 44*b*, the shoulder 78 on the rear wall 64 of the shroud has engaged the underside of the shelf 50. As the forward movement of the shroud over the pump body continues, the shoulder 78 moves forward to "home" position under the shelf 50 (FIG. 4). Such engagement keeps the rear portion of the shroud 40 down on the pump body 12. This engagement and the engagement of the flanges 44 in channels 74 anchor the shroud 40 firmly against any vertical displacement from the pump body 12.

After the complete assembly of the accouterments—that is, the nozzle cap, trigger, spring, piston, and collar—onto the pump body, final assembly described above is a simple process readily accomplished by automatic assembly equipment. It involves merely the appropriate lining up of the flanges 44 and the channels 74 and the moving forward of the shroud over the pump body in a uni-directional linear movement. This shroud/pump body assembly is readily accomplished irrespective of any difference of the external shape of the shroud.

It is thus possible for the assembler to offer his customer a wide variety of shroud shapes and colors differing vastly from one another. When assembled with the selected shroud, the resulting dispensing pump has a totally different appearance from those with different shrouds. This is because the shroud is the major portion of the dispenser appearance.

Just as the assembly of shroud onto the pump body can be made after the assembly of the pump body with its accouterments, the shroud/pump body assembly can be made prior to installing the accouterments on the pump body. The invention is beneficial without regard to order of assembly.

It should be clear to those skilled in the art that a variety of other pump means can take the place of the piston pump 24, 26 disclosed. Such other pump means—bellows pumps, rolling-walled chambers, etc.—are the structural equivalents of the pump shown.

Both the shroud 40 and the pump body 12 may be separate unitary molded parts of a plastic material such as polypropylene.

Modifications

Views of a modified form of the invention are in the fragmentary views FIGS. 8–11, FIG. 8 is similar to FIG. 6. The flanges 144 are received into the opposed channels 174 which extend down from the top wall 168 of the shroud. The flanges are in the same horizontal plane and extend in opposite directions being supported respectively by the webs 142.

Figure 9:
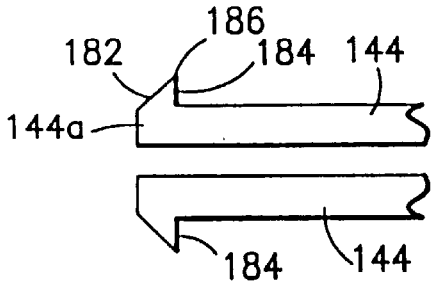
FIG. 9 is a fragmentary top plan view of the FIG. 8 modified flanges.
Figure 10:
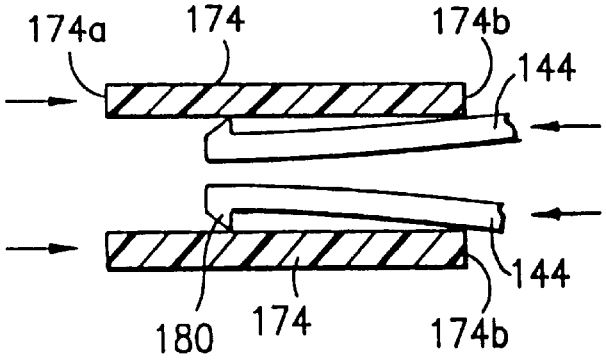
FIG. 10 is a fragmentary sectional view taken on the line 10—10 of FIG. 8 showing the flanges sliding into the channels.

The flanges 144, as shown in FIG. 9, are formed with hooks 180 which extend outward from the rearward edge thereof. The hooks have an inclined front surface 182 and a rear surface 184 perpendicular to the length of the flange. They cooperate with the rearward end 174*a* (FIGS. 10, 11,) in holding the flanges from lengthwise displacement out of the channels. In the assembly of the modification, the rearward end 144*a* of the flanges are aligned with the longitudinal slots of the respective channels 174.

In assembly, with the channels 174 aligned with the respective flanges 144, the shroud is brought forward in a uni-directional movement. The entry of the channels 174*b* (FIG. 10) may be bevelled (not shown) in their inner edges to provide a lead-in for the hooks 180. As the channels progress over the rearward end 144*a* of the flanges, the rear ends of the flanges are squeezed together (FIG. 10) by the channels, flexing the webs 142 as shown. When the hooks 180 reach the rearward transverse surface 174*a* of the channel, the rearward end of the flanges snap out, restoring the flanges to normal shape. At this point (FIG. 11) the surfaces 184 of the hooks 180 block the return of the flanges lengthwise of the channel, and therefore, the removal of the shroud 140 (comparable to shroud 40, FIG. 4) from the pump body.

Figure 8:
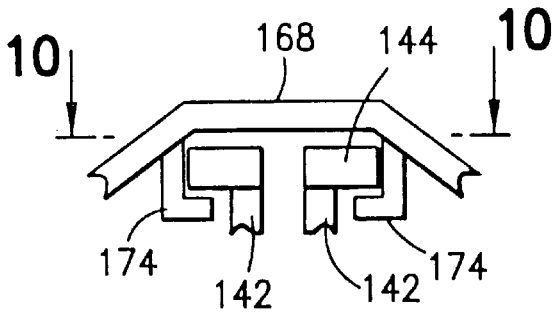
FIG. 8 is a sectional view comparable to FIG. 6 and showing a modified form of attachment.
Figure 11:
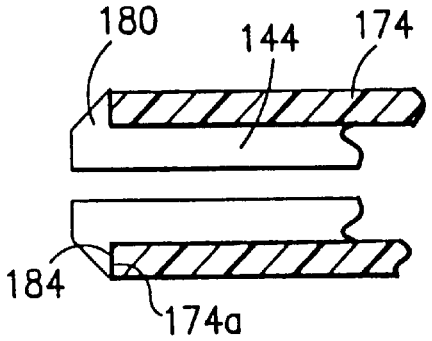
FIG. 11 is a fragmentary sectional view similar to FIG. 10 but showing the modified flanges snapped out in installed position.

Preferably, the engagement described in connection with FIGS. 8 and 11 is coupled with a shelf/shoulder arrangement such as 50, 78 of the FIG. 4 version. It may be, however, while not preferred, that if the channels 174 or 74 are of sufficient length and the flanges 144, 44 are also, suitable stability of the mounting of the shroud on the pump body can be established without the shelf/shoulder arrangement. In any event, the provision of the snap lock, such as the locking wedges 76 and latching section 44*b* or in the modification the hook 180 with the locking channel 174 or some similar snap arrangement, is necessary to afford secure attachment.

Figure 12:
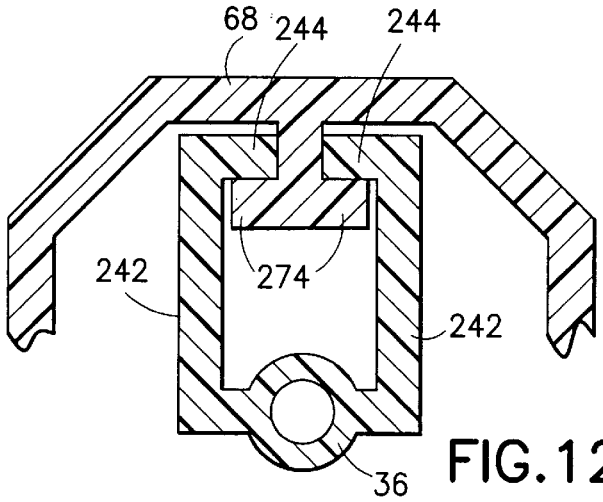
FIG. 12 is an enlarged sectional view comparable to FIG. 5 of the further modified form of the invention.

Just as the latching section can be in the form of hooks as in the FIGS. 8–11 modification, the channels themselves may be modified and still fall within the scope of the invention. In the further modification FIGS. 12, 12A the channels 274 are back-to-back in an upside-down T-shape and face outwardly. The flanges 244 are directed inwardly so that the entire flange structure has a box-shaped cross-section with a slot at the top. The operation, once the flanges and channels are lined up, is the same with the wedges 276 which snap-fit with the latching section 244*b* to prevent subsequent rearward movement of the shroud away from the body. As shown in the perspective view FIG. 12A, the box-shaped flange has an interruption 249 therein.

Figure 12A:
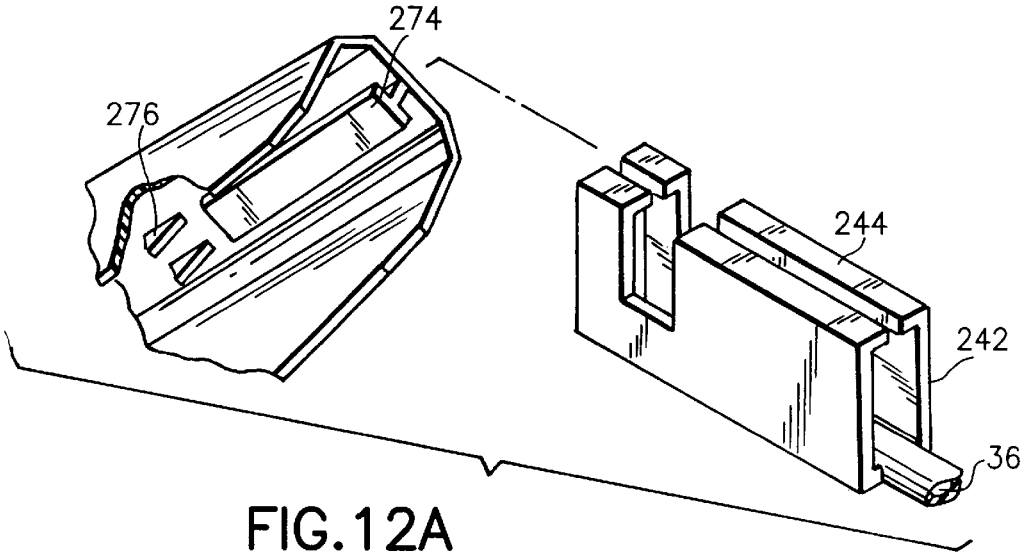
FIG. 12A is a fragmentary exploded perspective view of the two parts of FIG. 12 prior to assembly.

Rather than being on the top wall of the shroud as in FIG. 12A, the wedges can, in a still further modification (not shown), be formed in the channels on the upper surface of the cross-piece of the "T" whereby, as the box-like flanges move into the "T", the flanges have an interruption, as in the FIG. 12A modification, which snap-fits past the wedges on the cross-piece of the "T" to block subsequent retraction of the shroud from the pump body.

Figure 13:
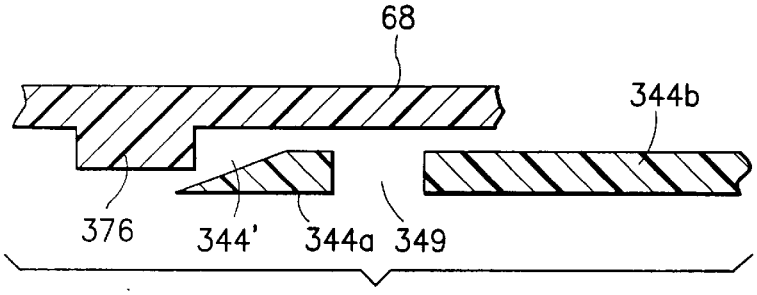
FIG. 13 is an enlarged sectional view comparable to FIG. 7*a* of the still further modified form of the invention.
Figure 14:
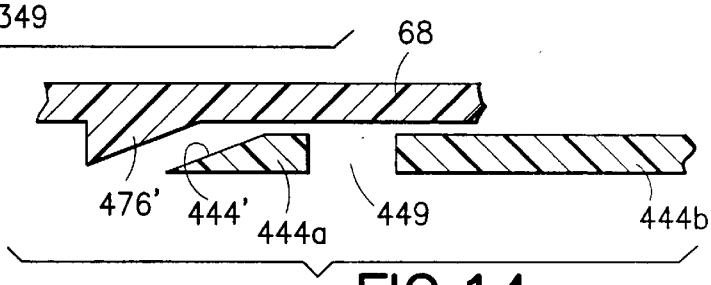
FIG. 14 is a view comparable to FIG. 13 of an additional modified form of the invention.

FIGS. 13 and 14 show modifications to the shaping of the wedges and latching sections. More specifically, in the FIG. 13 embodiment the latching section 344*a* has a bevelled lead-in 344' and the wedge 376 takes the form of a block, the front face of which is vertical, the bevelled lead-in serving to assist the sliding engagement of the two parts, the wedge finally ending in the interruption 349.

FIG. 14 shows that the wedge 476' has the usual bevelled face, and the latching section 444*a* is also formed with a bevel 444' to facilitate the sliding engagement between the wedge and latching section, whether the wedge moves up or the latching section moves down, or both, the wedge ends in the interruption 449.

In the preferred embodiment and the modifications, the invention may be regarded as a method of assembly which involves the lining up of the flanges of the respective channels and the forward movement of the shroud over the pump body in a uni-directional linear movement to a position at which the snap engagement of the latch sections 44*b* over the wedges 76 or the hooks 180 over the transverse surfaces 174*a* of the channels 174.

For purposes of the definition of the invention in the claims "transverse blocking surfaces" are surfaces transverse to the length of the shroud or pump body such as the wedge surface 76*b* and forward surface of latching section 44*b* or hook surface 184 and channel surface 174*a*.

"Latching means" refers to a portion of the flanges. "Locking means" refers to a portion of the shroud which interferes with the "latching means" as the shroud is moved forward over the pump body in assembly. One or both of the "latching means" or "locking means" gives way as the portions pass each other and then snaps back to hold the shroud on the pump body.

Further variations in the invention are possible. Thus, while the invention has been shown in limited embodiments, it is not so limited but is of a scope defined by the following claim language which may be broadened by an extension of the right to exclude others from making, using or selling the invention as is appropriate under the doctrine of equivalents.

What is claimed is:

1. A trigger-type dispensing pump comprising a. a pump body having pump means and being adapted to mount a pivoted trigger for operating the pump means, the pump body being further defined by a tubular support adapted to be connected to a container and supporting the pump means, and a substantially horizontal outlet tube connected to the pump means, the body integrally formed with a pair of elongate flanges, the flanges being disposed in a common horizontal plane and being directed toward each other, at least one of the flanges being formed with latching means, b. an open-fronted shroud adapted to substantially cover the pump body and comprising an elongate top wall and connecting side walls and rear end wall, the shroud adapted to slide over the pump body from a rearward direction, the shroud being formed therealong with horizontal back-to-back channels facing away from each other and adapted to slidingly receive respectively the flanges on the pump body, and locking means on the shroud adapted to forcibly engage the latching means, and snap past the latching means to hold the shroud on the pump body.

2. A trigger-type dispensing pump as claimed in claim 1 wherein the back-to-back channels are in the form of an inverted "T".

3. A trigger-type dispensing pump as claimed in claim 1 wherein one of the locking means or latching means is formed with a cam surface to assist in the riding of the locking means over the latching means.

4. A trigger-type dispensing pump as claimed in claim 3 wherein the latching means has a cam surface.

5. A trigger-type dispensing pump as claimed in claim 3 wherein the locking means has a vertical front face.

6. A trigger-type dispensing pump as claimed in claim 1 wherein the flanges are each interrupted to define a front support section and a rear latching section comprising the latching means and the shroud is formed with a locking wedge comprising the locking means and having a sloping forward surface and a rearwardly facing vertical surface.

7. A dispensing pump as claimed in claim 1 wherein the channels extend outwardly away from each other and the flanges face inwardly toward each other.

8. A trigger-type dispensing pump comprising:

a. a pump body having pump means and the pump body being further defined by a tubular support adapted to be connected to a container and supporting the pump means and a substantially horizontal outlet tube connected to the pump means, the body formed with elongate flanges integral therewith, the flanges being disposed in a common horizontal plane and extending in opposite directions, at least one of the flanges having an interruption to define a rear latching section having a bevelled face and a forward support section, the tubular support being formed with an integral downwardly facing shelf spaced below the flanges, b. an open-fronted shroud adapted to substantially cover the pump body and comprising an elongate top wall and connecting side walls and rear end wall, the shroud adapted to slide over the pump body from a rearward direction, the shroud being formed therealong with channels adapted to slidingly receive respectively the flanges on the pump body, and at least one integral downward locking means having a vertical front face and adapted to forcibly engage the rear latching section, the bevelled face first and snap past the shroud on the pump body, and an inward horizontal shoulder adjacent the rear end wall and vertically spaced from the channels and adapted to slide snugly under the shelf on the pump body.

9. A trigger-type dispensing pump as claimed in claim 8 wherein the channels face inwardly toward each other and the flanges face outwardly away from each other.

* * * * *